US009867409B1

(12) United States Patent
Mróz

(10) Patent No.: US 9,867,409 B1
(45) Date of Patent: Jan. 16, 2018

(54) TOWEL WITH A STABILIZING FOLD

(71) Applicant: Tomasz Mróz, Zgorzelec (PL)

(72) Inventor: Tomasz Mróz, Zgorzelec (PL)

( * ) Notice: Subject to any disclaimer, the term of this patent is extended or adjusted under 35 U.S.C. 154(b) by 0 days.

(21) Appl. No.: 15/397,285

(22) Filed: Jan. 3, 2017

Related U.S. Application Data

(60) Provisional application No. 62/405,993, filed on Oct. 10, 2016.

(51) Int. Cl.

| | |
|---|---|
| ***A47G 9/06*** | (2006.01) |
| ***A41D 15/04*** | (2006.01) |
| ***A47C 31/11*** | (2006.01) |
| ***A41F 1/00*** | (2006.01) |
| ***A44B 17/00*** | (2006.01) |
| ***A44B 1/00*** | (2006.01) |
| ***A44B 19/00*** | (2006.01) |
| ***A44B 18/00*** | (2006.01) |
| ***A47K 10/02*** | (2006.01) |
| ***A41D 23/00*** | (2006.01) |
| ***A41D 27/20*** | (2006.01) |

(52) U.S. Cl.
CPC ..... *A41D 15/04* (2013.01); *A41D 23/00* (2013.01); *A41D 27/205* (2013.01); *A41F 1/002* (2013.01); *A44B 1/00* (2013.01); *A44B 17/0023* (2013.01); *A44B 17/0064* (2013.01); *A44B 18/00* (2013.01); *A44B 19/00* (2013.01); *A47C 31/11* (2013.01); *A47K 10/02* (2013.01); *A41D 2600/10* (2013.01)

(58) Field of Classification Search
CPC ..... A51D 15/04; A47G 9/06
USPC ..... 5/417–420
See application file for complete search history.

(56) References Cited

U.S. PATENT DOCUMENTS 5,326,152 A * 7/1994 Baron ..... A47C 1/14 206/430
5,843,556 A * 12/1998 Levas ..... A45F 4/02 190/2
2012/0030877 A1* 2/2012 Beck ..... A47D 15/003 5/655

FOREIGN PATENT DOCUMENTS

EP 003156090-0001 5/2016

* cited by examiner

*Primary Examiner* — Fredrick Conley

(57) ABSTRACT

The present invention relates to a towel with a stabilizing fold for use mainly at a gym, at a pool, on a beach, and during sport activities, especially running and playing basketball. The towel, with an upper first end and a lower second end, having a front and a reverse side, comprises a stabilizing fold with a front side and a reverse side, a pocket attached to the reverse side of the stabilizing fold, a zipper attached to the front side of the stabilizing fold, a hanger having a first magnet and a second magnet, a cord connecting the first magnet and the second magnet, having a first end and a second end, and a means of attaching the stabilizing fold to the reverse side of the towel. The stabilizing fold is created by bending backwards the upper first end of the towel approximately at ⅙ length of the towel measured from a top. A gap is created between the reverse side of the stabilizing fold and the reverse upper side of the towel after bending backwards the upper first end of the towel when at least one snap fastener socket engages at least one snap fastener stud of at least one snap connector member.

4 Claims, 8 Drawing Sheets

TOWEL WITH A STABILIZING FOLD

BACKGROUND OF THE INVENTION

(1) Field of the Invention

The present invention relates to a towel with a stabilizing fold. The intended uses of the towel include mainly a gym, a pool, a garden, and a beach, where the stabilizing fold, with the towel, can be imposed on an upper part of back support of a seat of an exercise machine, a sunbed, and a beach chair, to prevent sliding down, falling down, and displacement of the towel during exercising at the gym or while using the towel at the pool, in the garden and on the beach.

The towel with the stabilizing fold also can be placed around a neck during indoors and outdoors sport activities like running or playing basketball. Another advantage of the stabilizing fold is use of a small pocket, sewed to the reverse side of the fold, for storage of personal items at the gym, pool, in a garden, and on a beach. Furthermore, the stabilizing fold contains a small opening in the front side allowing a cable to pass through to connect a music generating device located inside the pocket with a headphones outside the pocket to listen to music when the fold is attached to and detached from the towel.

(2) Description of Related Art Including Information Disclosed Under 37 CFR 1.97 and 37 CFR 1.98

Generally, a towel is a product made of cotton used mainly to absorb sweat, moisture or other matters from surface of a human body. Towels can be made in different sizes, thickness, shapes, and colours depending on their various applications.

From the U.S. Pat. No. 8,239,985 a towel is known with one or more recessed pockets. Each recessed pocket may comprise the permanent attachment mechanism for attaching each of the recessed pockets to a main body of the towel. The towel may further comprise a permanent securing mechanism for securing portions of opposite sides of the first recessed pocket to each other.

The U.S. Pat. No. 8,689,371 teaches a hygienic bench towel for covering an exercise bench before a user sits on the bench to protect the user from sweat, germs and contamination left by a previous user. The bench towel has a semi rigid handle which enables a user to move the towel form one bench to another without touching the contaminated side of the towel. Another advantage provided by the handle is that the user always knows which side of the towel should be placed against the workout bench.

From the U.S. Pat. No. 8,756,742 a sports towel is known constructed in the form of bag having an interior surface and an exterior surface wherein soil on the interior surface is prevented from transfer to the exterior surface is provided. The towel includes a bag-shaped body constructed of a fabric material. The body has opposing first and second ends and a continuous peripheral wall extending between said first and said second ends.

The U.S. Pat. No. 8,544,135 discloses a towel for cleaning and drying a surface that contains a first portion, a second portion, and a pocket formed in the first portion. The first portion includes an underlying layer of material and two outer layers of material. The second portion is formed primarily of a material different from the outer layer of the first portion. The pocket is formed in the first portion between the underlying layer and the outer layer for receiving a user's hand or foot.

DETAILED DESCRIPTION OF THE INVENTION

The object of the present invention is the towel with an upper first end and a lower second end, having a front and a reverse side, comprising a stabilizing fold with a front side and a reverse side, a pocket attached to the reverse side of the fold, a zipper attached to the front side of the fold, a hanger having a first magnet and a second magnet, a cord connecting the first magnet and the second magnet, having a first end and a second end, and a means of attaching the stabilizing fold to the reverse side of the towel.

The stabilizing fold is created by bending the upper first end of the towel backwards approximately at ⅙ length of the towel measured from a top.

The towel and stabilizing fold are made 100% of cotton, and the fold comprises a lining made 100% of polyester sewed by a thread to the reverse side of the fold. The stabilizing fold is freely attached to and detached from the towel.

The towel is made mainly in colors black, grey, red, pink, green, blue, navy blue, yellow, orange, white, purple, brown, beige, graphite, turquoise, burgundy and combinations of said colors.

Generally, a person puts his/her towel at a gym on a gym equipment mainly on a seat and/or back support of an exercise machine before exercising. There are two reasons for doing that: first to avoid a contact with sweat left by a person exercising earlier on the same machine, and second, to avoid leaving own sweat on gym equipment. However, an ordinary towel does not often stay in the place in which was originally left. Most likely the towel will fall on a floor of the gym (during exercising) or a pool or on a ground in the garden or on a beach due to gravity, a wind, or a movement of the person using the towel. In such instances the towel cannot be used anymore. After falling on a gym floor or a ground the towel becomes dirty and cannot be used to wipe the sweat off a body of the person. The stabilizing fold prevents the towel from falling and sliding down on a floor or on a ground from an exercise machine, a beach chair or a sunbed, and its unintentional displacement by a person using the towel, when such person is laying on the towel on his/her back.

The stabilizing fold solves a problem not only with a lack of stability of the towel during exercising at the gym, but also provides a high level of hygiene. The towel is clean since it does not fall on the gym floor. Moreover, a person using the towel knows that a reverse side of the towel, with the fold, had a direct contact with gym equipment so such person will not use that side of the towel to wipe off the sweat from his/her body.

Dimensions of a towel used at a gym do not do not exceed 90 cm (35.4 inch) in length and 40 cm (15.7 inch) in width. Dimensions of the stabilizing fold do not exceed 17 cm (6.6 inch) in length and 40 cm (15.7 inch) in width. Dimensions of the pocket do not exceed 13 cm (5.1 inch) in length and 36 cm (14.1) in width. Dimensions of the zipper do not exceed 1 cm (0.3 inch) in length and 36 cm (14.1 inch) in width. A thickness of the towel is between 300 g/m$^2$ (10.1 fl oz/3229.17 ft$^2$) and 500 g/m$^2$ (16.9 fl oz/5381.96 ft$^2$).

Dimensions of a towel used on a beach, at a pool, and in a garden do not exceed 160 cm (62.9 inch) in length and 100 cm (39.3 inch) in width. Dimensions of the stabilizing fold do not exceed 35 cm (14.1) in length and 100 cm (39.3) in width. Dimensions of the pocket do not exceed 20 cm (7.8 inch) in length and 80 cm (31.4) in width. Dimensions of the zipper do not exceed 2 cm (0.7 inch) in length and 80 cm (31.4 inch) in width. A thickness of the towel is between 300 $g/m^2$ (10.1 fl oz/3229.17 $ft^2$) and 500 $g/m^2$ (16.9 fl oz/5381.96 $ft^2$).

In summary, the range of the length of the towel, depending on its intended use, is 90 cm (35.4 inch) to 160 cm (62.9 inch), and the range of the width of the towel is 40 cm (15.7 inch) to 100 cm (39.3 inch). The range of the length of the stabilizing fold is 17 cm (6.6 inch) to 35 cm (14.1), and the range of the width of the stabilizing fold is 40 cm (15.7 inch) to 100 cm (39.3 inch). The range of the length of the pocket is 13 cm (5.1 inch) to 20 cm (7.8 inch), and the range of the width of the pocket is 36 cm (14.1) to 80 cm (31.4).

Finally, the range of the length of the zipper is 1 cm (0.3 inch) to 2 cm (0.7 inch), and the range of the width of the zipper is 36 cm (14.1 inch) to 80 cm (31.4 inch) respectively.

The fold (13) is attached to the reverse side of upper side edges of the first end of the towel by a means selected from the group consisting of snap connector members, buttons, zippers, hook and loop fasteners, and a sewing thread.

In the preferred embodiment of the present invention, displayed in the drawings, at least one snap connector member, joining at least one of a snap fastener stud (10)—a male element located on the upper side edges of the reverse side of the towel, with at least one of a snap fastener socket (9)—a female elements located on the upper side edges of a reverse side of the fold, connects the stabilizing fold with the towel. When pressure is applied simultaneously on both ends of at least one snap connector member at least one of the stud engages at least one of the socket.

The snap fastener studs and snap fastener sockets are made of steel, stainless steel, aluminum, copper, brass and plastic.

A gap is created between the reverse side of the stabilizing fold and the reverse side of the towel after bending backwards the upper first end of the towel approximately at ⅙ length of the towel measured from a top, and when at least one snap fastener socket engages at least one snap fastener stud of at least one snap connector member, after zippers, buttons, and hook and loop fasteners are closed, and after the fold (13) is sewed by a thread to the upper side edges of the reverse side of the upper first end of the towel. The gap allows imposition of the stabilizing fold with a towel on an upper part of seat backrest of an exercise machine (14) in a gym (like a leg press, a lat pull-down machine, a chest press, a pec fly machine, or a hip abductor machine and others), on an upper part of a sunbed, and on an upper part of a beach chair, to prevent sliding down, falling down, and displacement of the towel due to gravity, a wind, and a movement of person during exercising or while using the towel at the pool, in the garden and on the beach.

The stabilizing fold comprises the pocket (1, 5) sewed by a thread to the reverse side of the fold for storage of personal items like watches, keys, jewelry, phones, pens, body creams, snacks, music generating devices, money, and other similar items. The pocket is opened and closed by a zipper (2) sewed by a thread to the front side of the fold, and the zipper is secured by a stripe of material (3) in color of the towel sewed by a thread to the front side of the fold above and along the zipper, to prevent direct contact of the zipper with a human body (for example to prevent irritation of skin or any other kind of discomfort), and to enhance appearance of the towel.

The stabilizing fold comprises an opening (6) in a right lower corner on the front side allowing a cable to pass through the opening to connect a music generating device located inside the pocket with a headphones located outside the pocket. The small circular opening is secured by a rubber in a shape of a letter X made in color of the towel.

The first magnet (12) is attached permanently by stitching to the right corner of the upper first end of the towel on the front side. The second magnet (11) is not permanently attached to the towel. The first magnet is hemmed with a material constituting the first end of a cord, and the second magnet is attached to the second end of the cord. The second magnet is hemmed with same material as the first magnet. The cord is made of the material selected from the group consisting of leather, artificial leather, and a braided rope made of polypropylene.

The hanger (4) is created by imposing the second magnet on a top of the first magnet connected together by the cord. The towel with the stabilizing fold can be hanged by attaching the hanger to metal surfaces at the gym, and by placing the hanger of the towel on a hook (15).

In another embodiment of the present invention, the towel can be placed around a neck during indoors and outdoors sport activities, for example during running and playing basketball. The towel is folded in the center along its length to reduce its width and wrapped around the neck several times (between two and four times) to reduce its length. To hold the towel around the neck the lower second end of the towel is interposed between the first and second magnet of the upper first end of the towel.

BRIEF DESCRIPTION OF THE SEVERAL VIEWS OF THE DRAWING

In the accompanying drawings, in which are shown several of the various possible embodiments of the present invention.

Figure 1:
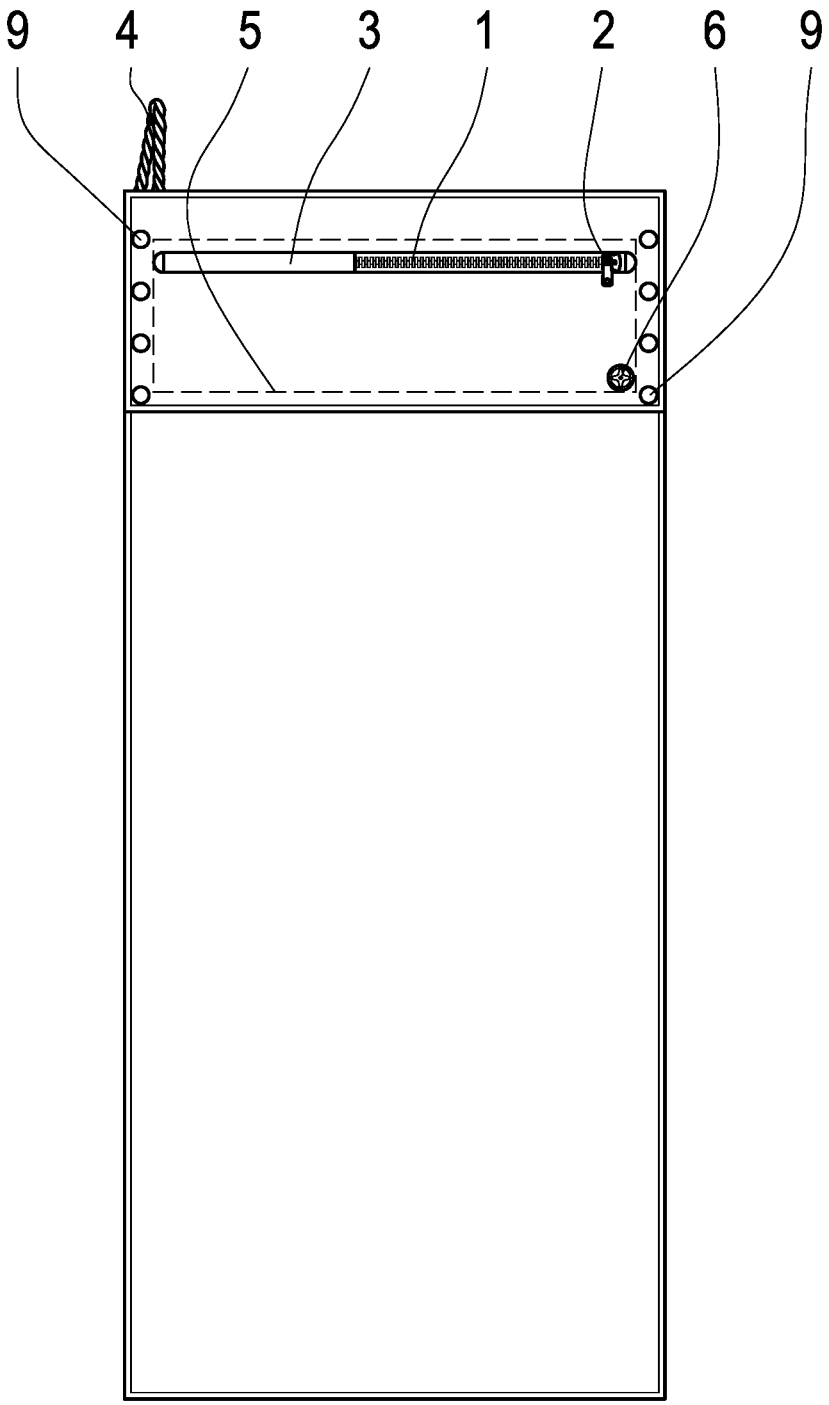
FIG. 1 is a rear view of the towel showing all elements of the stabilizing fold.
Figure 2:
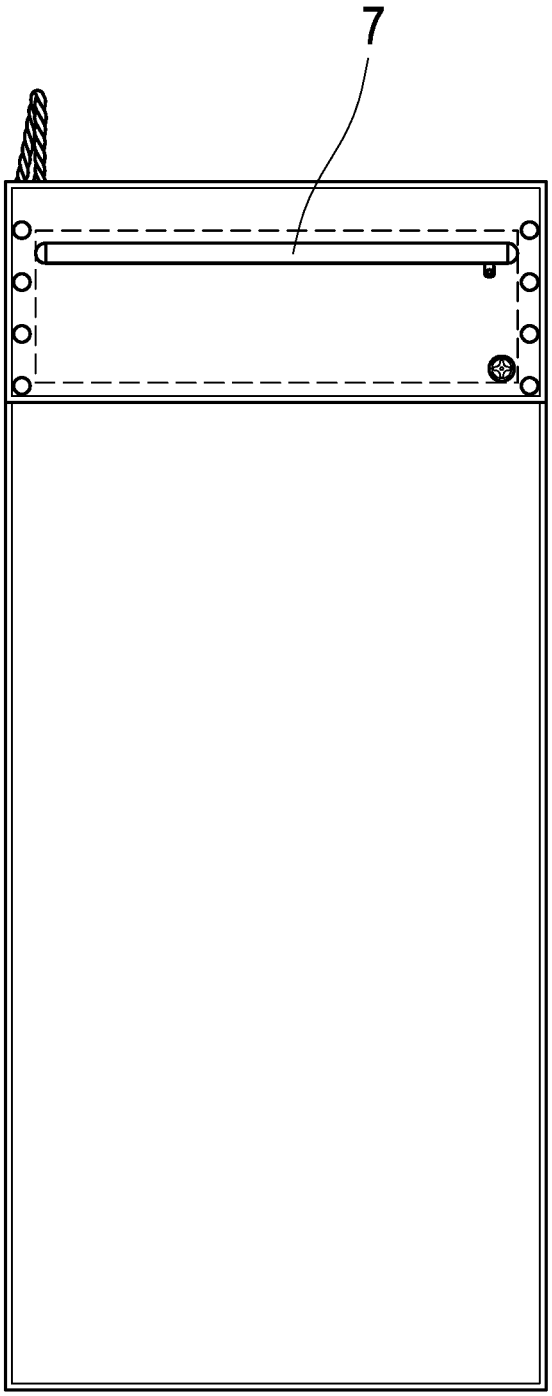
FIG. 2 is a rear view of the towel showing a stripe of material under which a zipper is located.
Figure 3:
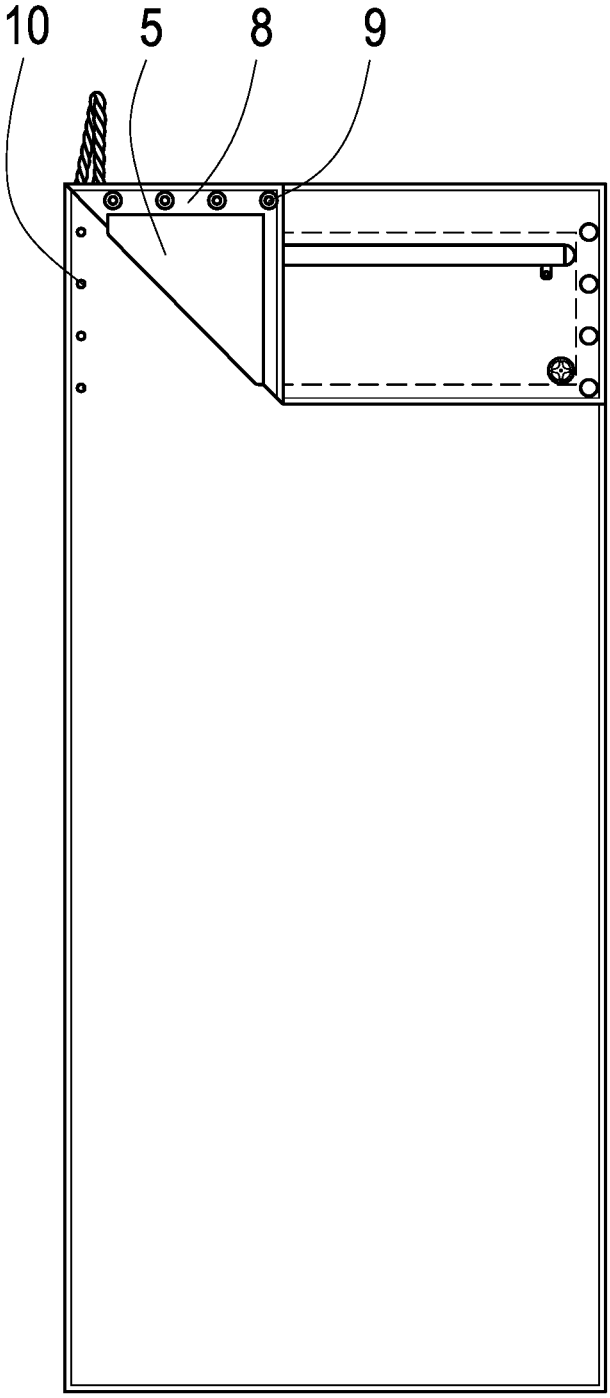
FIG. 3 is a rear view of the towel showing a reverse side of the stabilizing fold after opening.
Figure 4:
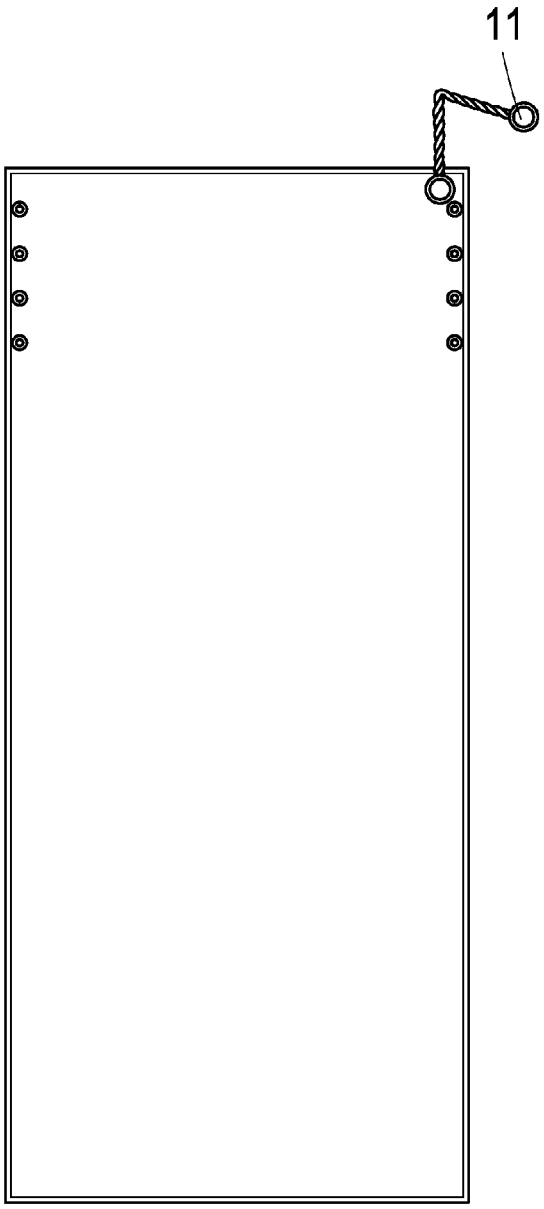
FIG. 4 is a front view of the towel showing an open hanger.
Figure 5:
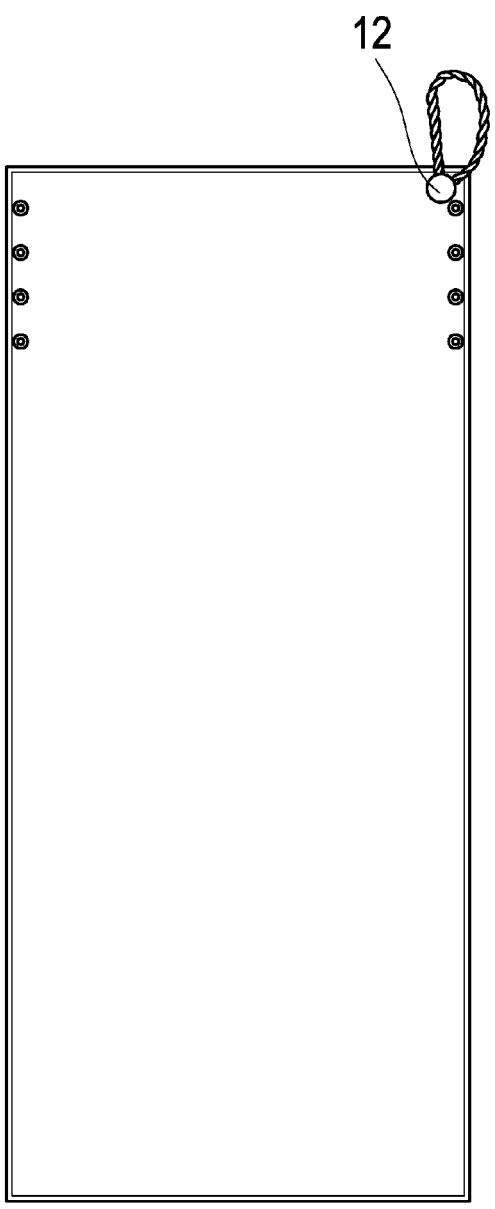
FIG. 5 is a front view of the towel showing a closed hanger.
Figure 6:
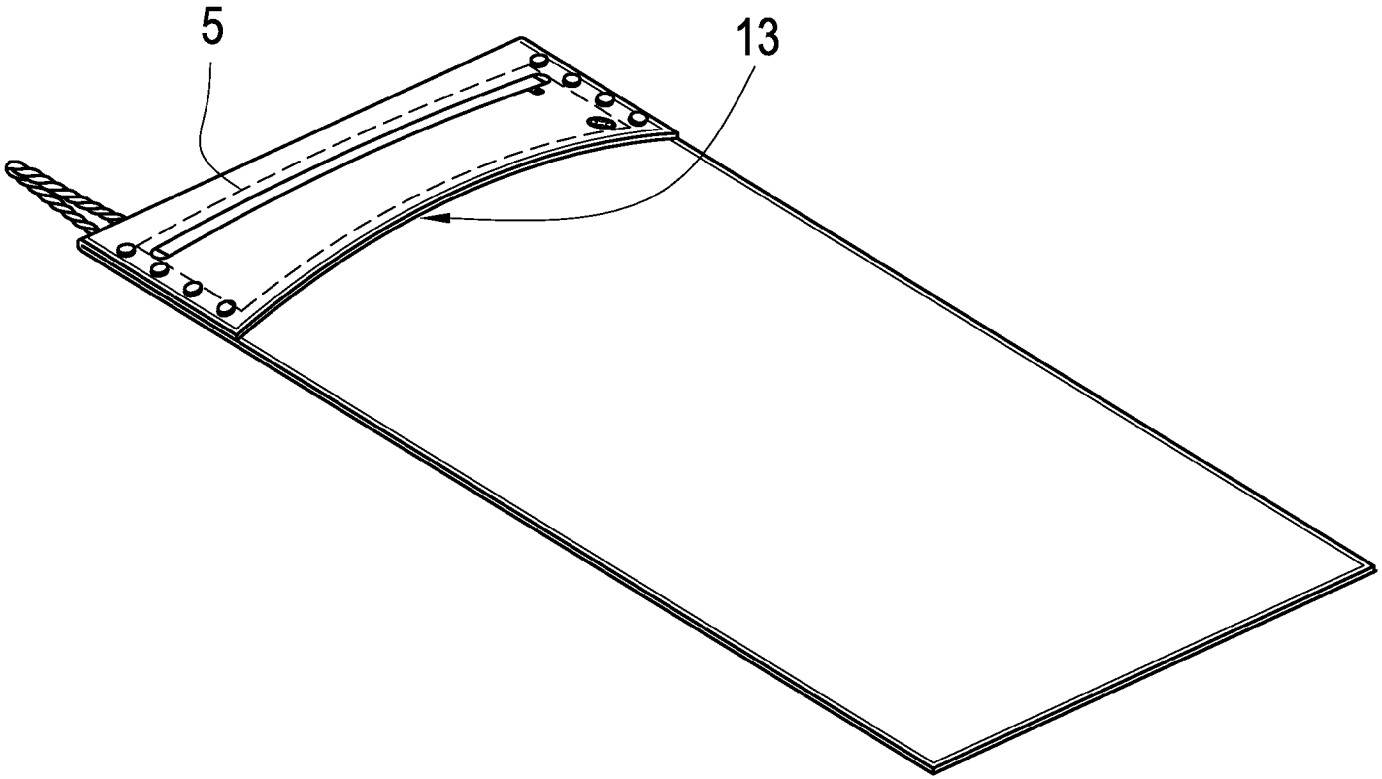
FIG. 6 is a rear perspective view showing the stabilizing fold.
Figure 7:
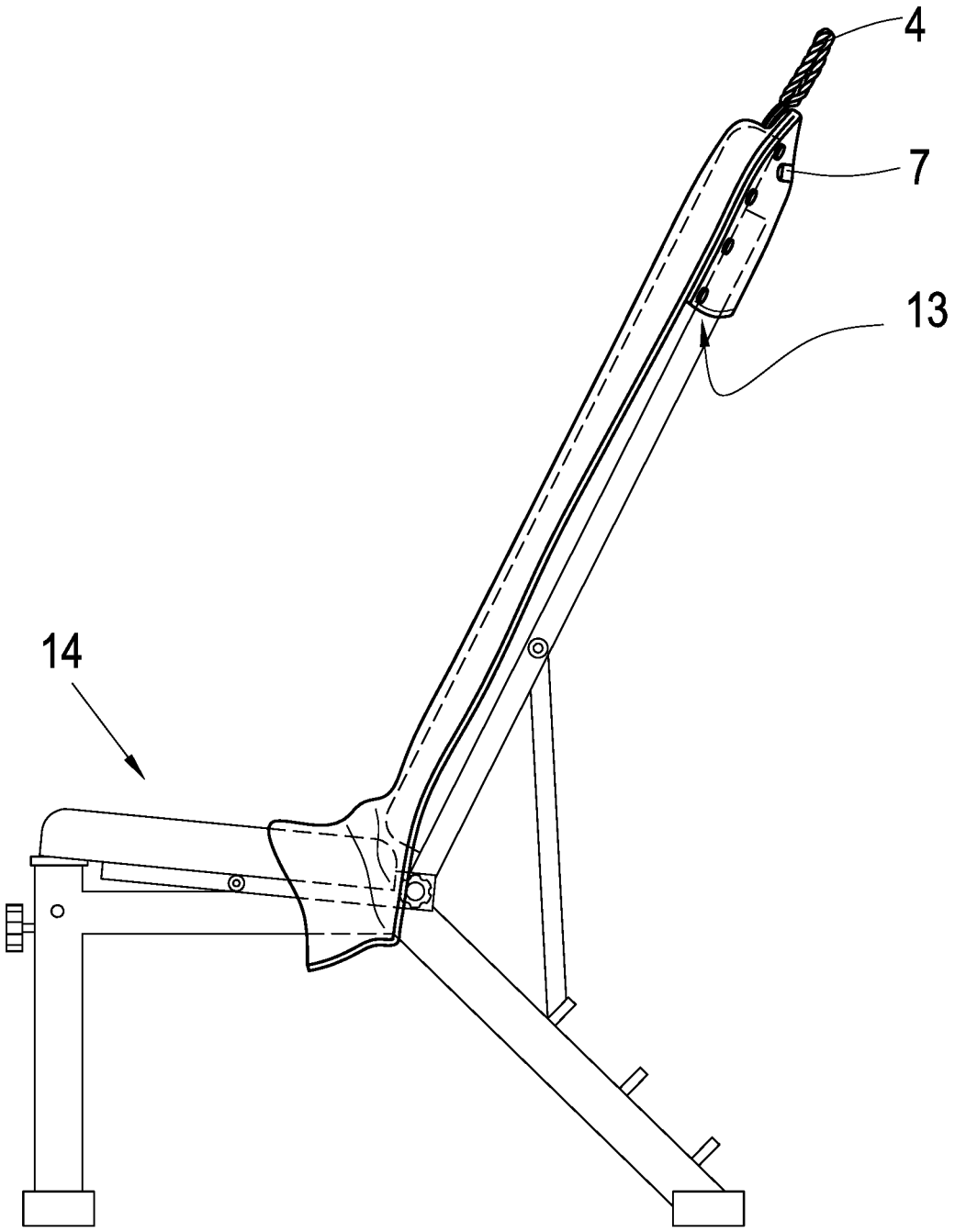
FIG. 7 is a front perspective view of the towel showing the towel placed on an upper part of seat backrest of an exercise machine
Figure 8:
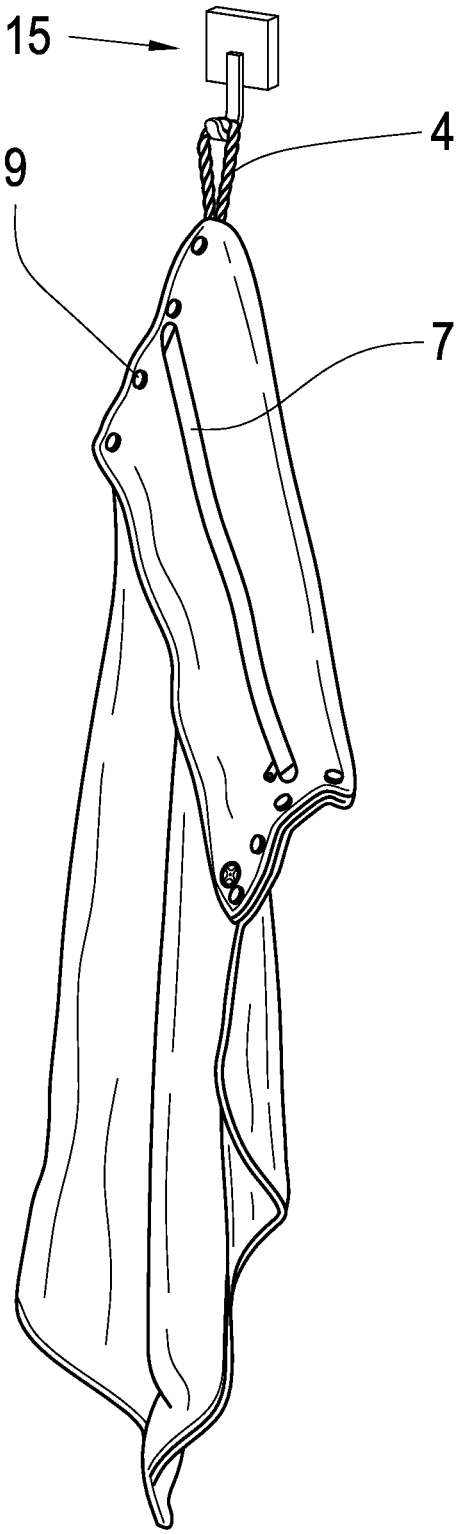
FIG. 8 is a front perspective view of the towel showing the towel hanging on a hook.
Figure 9:
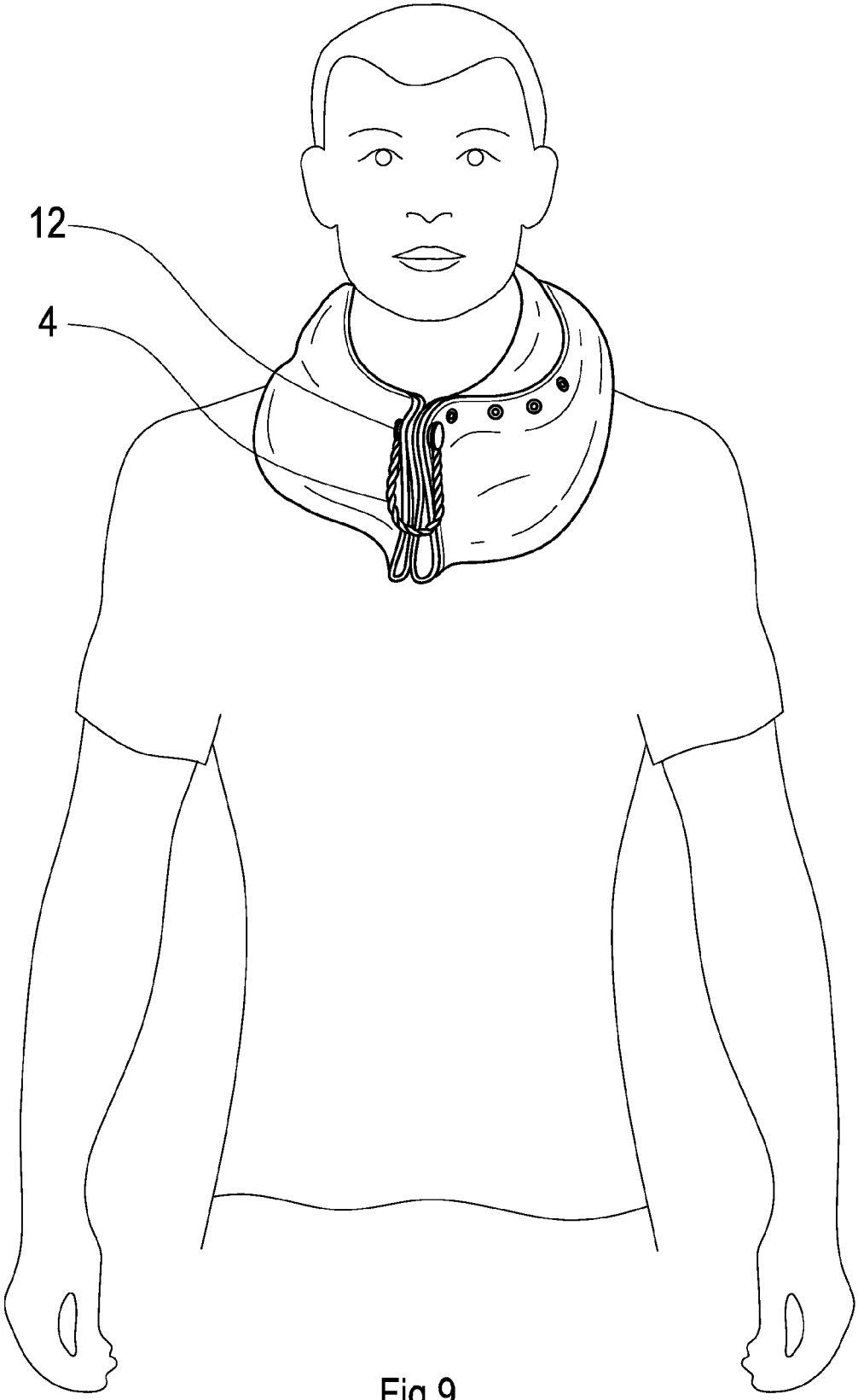
FIG. 9 is a front view of the towel showing the towel with stabilizing fold around the neck.

The above list of the elements of the towel and its applications is not exhausted, and only represents certain preferred solutions, which does not limit other solutions/embodiments according to the present invention.

LIST OF REFERENCE NUMERALS

1. A pocket sewed to the reverse side of the stabilizing fold
2. A zipper sewed to the front side of the stabilizing fold
3. A stripe of material covering the zipper
4. A hanger

5. A pocket (an outline)
6. An opening for a cable to a headphones
7. A stripe of material covering the zipper
8. A reverse side of the towel showing an open stabilizing fold on left side
9. A snap fastener socket of a snap connector member
10. A snap fastener stud of a snap connector member
11. An open hanger
12. A closed hanger
13. A fold
14. An exercising machine
15. A hook

The invention claimed is:

1. A towel with an upper first end and a lower second end, having a front and a reverse side, comprising a stabilizing fold with a front side and a reverse side, wherein the stabilizing fold is imposed on a top of back support of a seat of machines in the gym, on a top of sunbeds, and on a top of beach chairs to prevent the towel from sliding, failing down, and its dislocation, a pocket attached to the reverse side of the stabilizing fold, a zipper attached to the front side of the stabilizing fold, a hanger having a first magnet and a second magnet, a cord connecting the first magnet and the second magnet, having a first end and a second end, and a means of attaching the stabilizing fold to the reverse side of the towel, wherein the stabilizing fold comprises an opening in a right lower corner of the front side allowing a cable to pass through the opening to connect a music generating device located inside the pocket with a headphones outside the pocket to listen to music when the stabilizing fold is attached to or detached from the towel, wherein the opening is secured by a rubber in a shape of a letter X made in color of the towel.

2. A towel with an upper first end and a lower second end, having a front and a reverse side, comprising a stabilizing fold with a front side and a reverse side, wherein the stabilizing fold is imposed on a top of back support of a seat of machines in the gym, on a top of sunbeds, and on a top of beach chairs to prevent the towel from sliding, failing down, and its dislocation, a pocket attached to the reverse side of the stabilizing fold, a zipper attached to the front side of the stabilizing fold, a hanger having a first magnet and a second magnet, a cord connecting the first magnet and the second magnet, having a first end and a second end, and a means of attaching the stabilizing fold to the reverse side of the towel, wherein the first magnet is attached permanently by stitching to the right corner of the upper first end of the towel on the front side, wherein the second magnet is not permanently attached to the towel.

3. A towel with an upper first end and a lower second end, having a front and a reverse side, comprising a stabilizing fold with a front side and a reverse side, wherein the stabilizing fold is imposed on a top of back support of a seat of machines in the gym, on a top of sunbeds, and on a top of beach chairs to prevent the towel from sliding, failing down, and its dislocation, a pocket attached to the reverse side of the stabilizing fold, a zipper attached to the front side of the stabilizing fold, a hanger having a first magnet and a second magnet, a cord connecting the first magnet and the second magnet, having a first end and a second end, and a means of attaching the stabilizing fold to the reverse side of the towel, wherein the first magnet is hemmed with a material constituting the first end of the cord, wherein the second magnet is attached to the second end of the cord, and wherein the second magnet is hemmed with same material as the first magnet.

4. A towel with an upper first end and a lower second end, having a front and a reverse side, comprising a stabilizing fold with a front side and a reverse side, wherein the stabilizing fold is imposed on a top of back support of a seat of machines in the gym, on a top of sunbeds, and on a top of beach chairs to prevent the towel from sliding, failing down, and its dislocation, a pocket attached to the reverse side of the stabilizing fold, a zipper attached to the front side of the stabilizing fold, a hanger having a first magnet and a second magnet, a cord connecting the first magnet and the second magnet, having a first end and a second end, and a means of attaching the stabilizing fold to the reverse side of the towel, wherein the first magnet is hemmed with a material constituting the first end of the cord, wherein the second magnet is attached to the second end of the cord, wherein the second magnet is hemmed with same material as the first magnet, and wherein the cord is made of the material selected from the group consisting of leather, artificial leather, and a braided rope made of polypropylene.

* * * * *